US005560173A

United States Patent [19]

Scheiwiller

[11] Patent Number: 5,560,173

[45] Date of Patent: Oct. 1, 1996

[54] CONCRETE OR CERAMICS ELEMENTS

[76] Inventor: René Scheiwiller, Buolterlistrasse 9, CH-6052 Hergiswil, Switzerland

[21] Appl. No.: 422,653

[22] Filed: Apr. 14, 1995

Related U.S. Application Data

[63] Continuation of Ser. No. 66,442, May 25, 1993, abandoned.

[30] Foreign Application Priority Data

Nov. 30, 1990 [EP] European Pat. Off. ..... 90810936

[51] Int. Cl.[6] ..... E04C 2/04

[52] U.S. Cl. ..... 52/608; 52/603; 52/604; 52/311.2; 404/41

[58] Field of Search ..... 52/603, 605, 608, 52/609, 610, 311.2, 314; 404/41, 42

[56] References Cited

U.S. PATENT DOCUMENTS

| | | | |
|---|---|---|---|
| D. 317,208 | 5/1991 | Scheiwiller | D25/113 |
| 1,463,759 | 7/1923 | Carson et al. | 52/609 |
| 2,836,055 | 5/1958 | Shuman | 52/603 |
| 4,358,115 | 11/1982 | Haas | 273/157 R |
| 4,537,001 | 8/1985 | Uppström | 52/608 |
| 4,572,699 | 2/1986 | Rinninger | 52/608 X |
| 4,925,338 | 5/1990 | Kapusta | 404/41 |
| 5,081,807 | 1/1992 | Murdza | 52/609 |

FOREIGN PATENT DOCUMENTS

| | | |
|---|---|---|
| 0415093 | 3/1991 | European Pat. Off. . |
| 724248 | 4/1932 | France . |
| 2448312 | 4/1976 | Germany . |
| 3409114 | 9/1985 | Germany . |
| 100731 | 2/1989 | Germany . |
| 8901920 | 7/1989 | Germany . |

*Primary Examiner*—Kien T. Nguyen
*Attorney, Agent, or Firm*—Marks & Murase, L.L.P.

[57] ABSTRACT

All elements are designed in a modular manner on the base of a unitary length. They include elements comprising more than one square having side lengths a and a camfered edge b at an angle of 45°. The elements, which can be produced in the form of paving stones, or thin ceramics tiles, or trough stones and can be laid out to create floor or wall coverings, allow to lay out all letters, numbers or common symbols, as well as a great variety of other figures, and to provide them with straight-lined borderings without the need of breaking, grinding or otherwise altering a single element. It is understood that said elements can be differently colored in order to emphasize them.

6 Claims, 10 Drawing Sheets

CONCRETE OR CERAMICS ELEMENTS

This application is a continuation of application Ser. No. 08/066,442 filed May 25, 1993 now abandoned.

BACKGROUND OF THE INVENTION

The present invention refers to concrete or ceramics elements, in particular for the creation of floor or wall coverings, said elements being in the form of paving stones, ceramics tiles or trough stones. A multitude of paving stones, on one hand, and of ceramics tiles, on the other hand, are known which comprise decorative elements or are shaped in such a manner, respectively, that certain motifs are formed when they are laid out. Generally, however, unless the smallest of mosaic stones are used, these elements are too limited in their applications to allow the formation of any figures at random, including e.g. all letters, numbers or known symbols. EP-A-415,093 discloses a pentagonal stone which allows to lay out some motifs while a great number of figures, numbers or symbols cannot be produced, much less without cutting part of the stones.

SUMMARY OF THE INVENTION

By contrast, it is the object of the present invention to provide a relatively small number of elements allowing a far greater variety of layout patterns without the need of cutting or adapting the stones or tiles, and also allowing the simultaneous use of other stones of simpler shapes, such as square, rectangular or hexagonal elements. This is particularly advantageous also in the case where said elements are in the form of trough stones. This object is attained by concrete or ceramics elements wherein all of said elements are designed in a modular manner on the basis of a unitary length, and wherein a first element is provided which merely comprises three squares having said modular side length and forming an angle, all of said squares adjoining along the entire length of one of their sides, and the corner square being cut off along its diagonal.

BRIEF DESCRIPTION OF THE DRAWINGS

The invention is explained in more detail hereinafter with reference to a drawing of embodiments, wherein.

DESCRIPTION OF THE PREFERRED EMBODIMENTS

Figure 1:
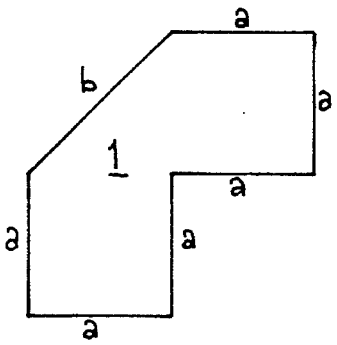
FIGS. 1–23 show twenty-three different elements.
Figure 2:
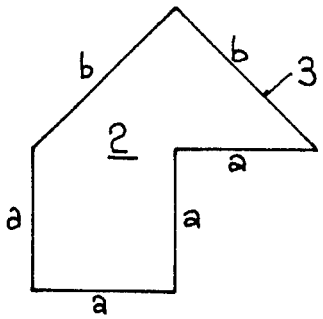
Figure 3:
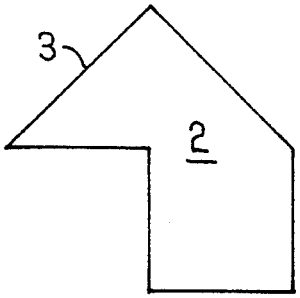
Figure 4:
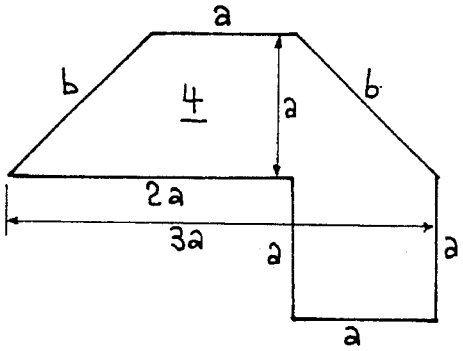
Figure 5:
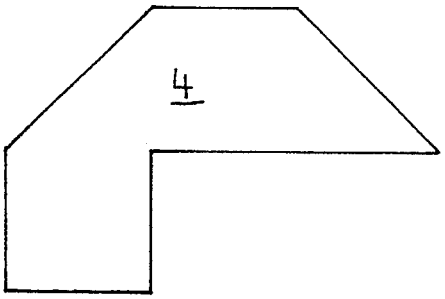
Figure 20:
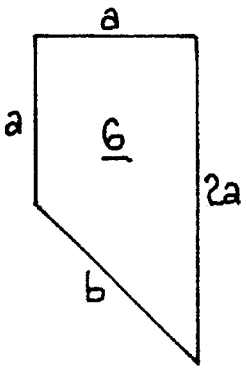
Figure 21:
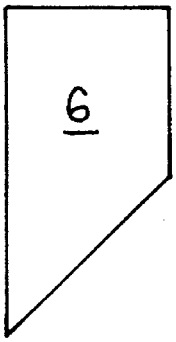
Figure 23:
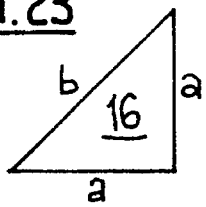

In FIGS. 1–5, three elements are illustrated which already allow to lay out a multitude of shapes and which, together with the elements according to FIGS. 20 or 21 and 23, allow to assemble all letters, capitals or lower-case, numbers, and current symbols and to produce a straight-lined bordering without the need of altering a single element. FIG. 1 shows a first element 1 which is composed of three squares having side lengths a arranged to form an angle, the edge along the diagonal of the center square being cut off and this side b having a length of $a\sqrt{2}$. FIGS. 2 and 3 show a second element 2 which is based on that of FIG. 1, an additional edge along a diagonal of another square being camfered to give a side 3 whose length b is $a\sqrt{2}$ as well. The element of FIG. 3 is the same as in FIG. 2, only in a mirror-image representation. FIGS. 4 and 5 show a third element 4 which, also based on element 1 in FIG. 1, comprises a half-square with side lengths a which is added on one side, so that the overall length amounts to 3*a* and the overall height to 2*a*. Element 4 thus consists of an equilateral trapezoid with a base length 3*a*, the length of the smaller parallel side being a, and an adjoining square with side lengths a on one side.

Elements 1, 2, and 4 may be assembled in different combinations, e.g. also with themselves, and it appears in FIGS. 24–32 that they are also combinable with other elements and in every case can be laid out with straight-lined borderings by means of simple geometrical elements such as rectangles, squares or half-squares with side lengths, a, 2*a* or 3*a*, of course.

Figure 6:
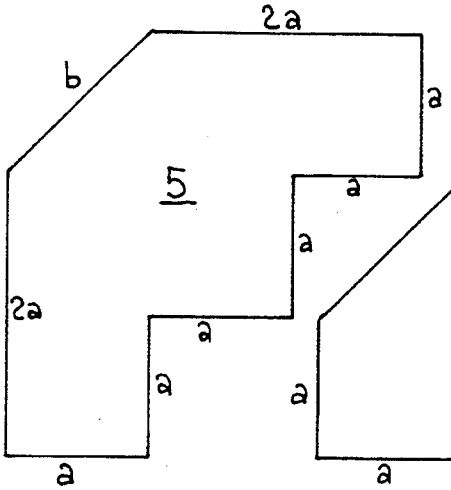
Figure 7:
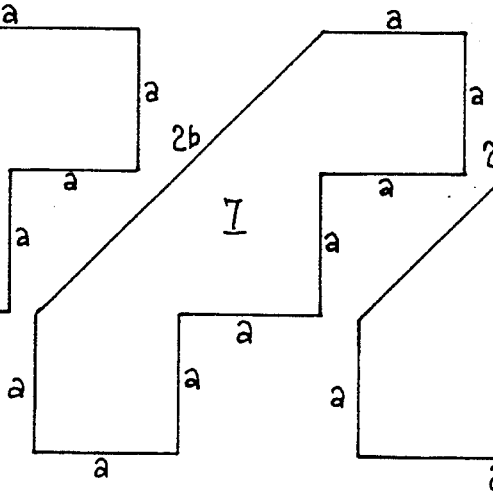
Figure 8:
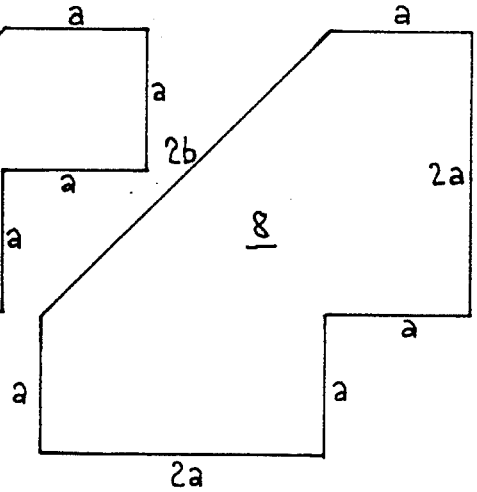
Figure 9:
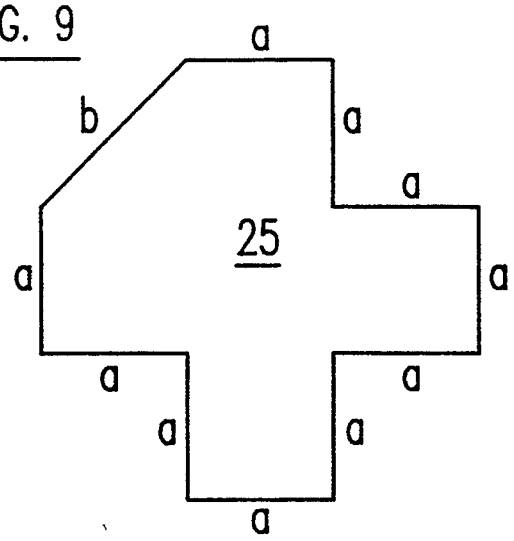
Figure 10:
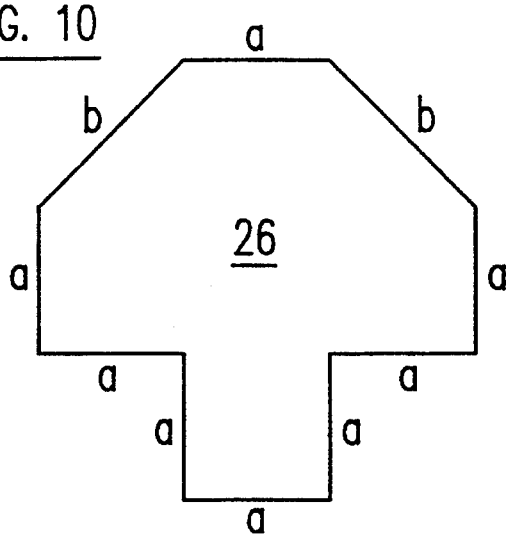
Figure 11:
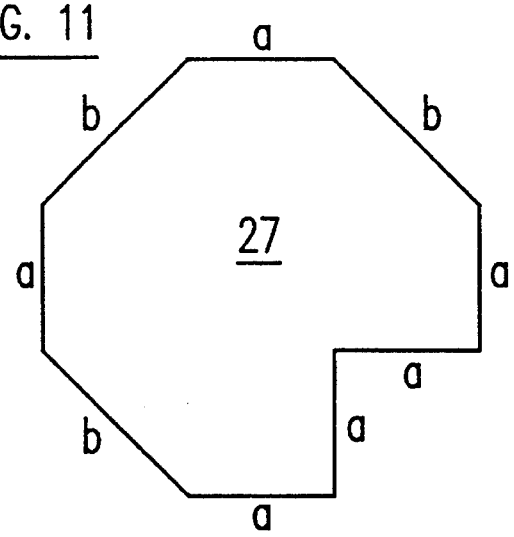

FIG. 6 shows a fourth element 5 which consists of the first element 1 with three adjoining squares which are added to those sides which are not adjacent camfered side b. The sixth element 7 according to FIG. 7 corresponds to element 1 with an additional fifth element 6 according to FIG. 20 or 21, while the seventh element 8 according to FIG. 8 corresponds to element 7 of FIG. 7 with two added squares. FIGS. 9, 10, and 11 show further elements 25, 26, and 27 which include element 1, element 25 being derived from element 1 with three added squares with side lengths a, element 26 being derived from element 4 with three added squares having side lengths a, and element 27 being composed of two elements 4.

Figure 12:
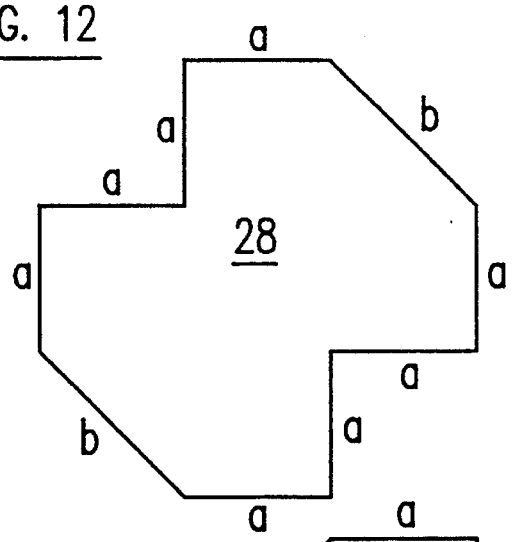
Figure 13:
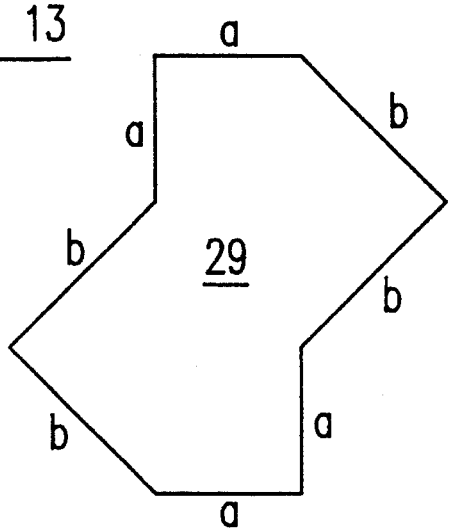
Figure 13:
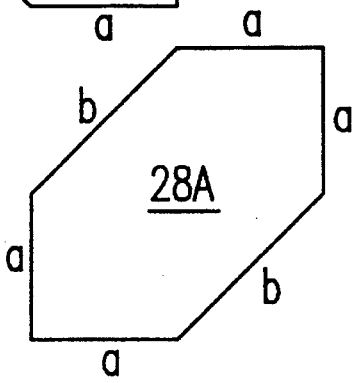

Element 28 of FIG. 12 is an additional element formed of two rhombic elements with sides a and b, and element 29 of FIG. 13 is a filler element composed of two mirror-symmetric house-shaped parts with sides a and b.

Figure 14:
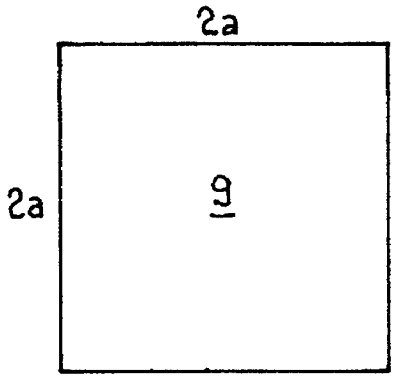
Figure 15:
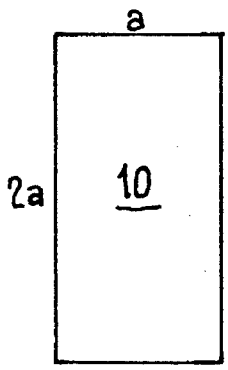
Figure 16:
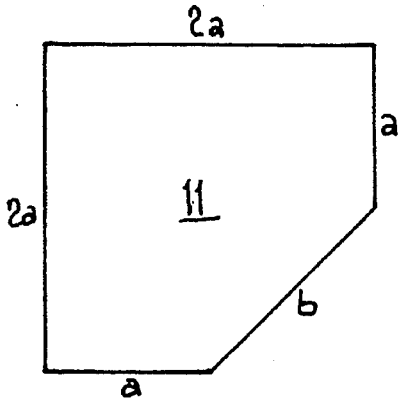
Figure 17:
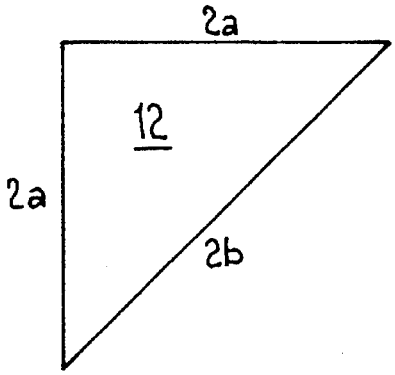
Figure 18:
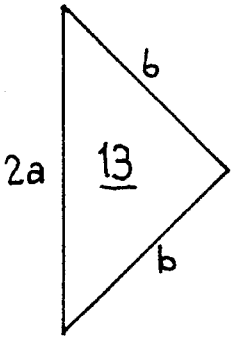
Figure 19:
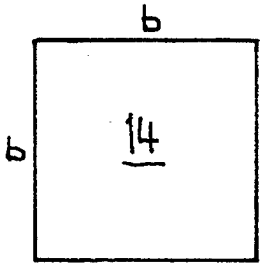
Figure 22:
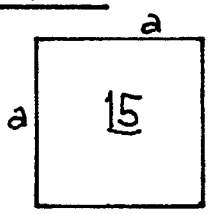

FIG. 14 shows a square with side lengths 2*a*, and FIG. 15 shows a rectangle 10 with side lengths a×2*a*, the eighth element 11 of FIG. 16 corresponding to square 9 of FIG. 14 less half a square with side lengths a, while the isosceles triangle 12 of FIG. 17 corresponds to the half of square 9 of FIG. 14 and the isosceles triangle 13 corresponds to a quarter of the square of FIG. 14. Square 14 of FIG. 19 has a side length $b=a\sqrt{2}$, while square 15 of FIG. 22 has a side length a and the isosceles triangle 16 in FIG. 23 corresponds to half of the square of FIG. 22. The fifth element 6 corresponds to square 15 with side lengths a plus half of square 16 according to FIG. 23.

Figure 24:
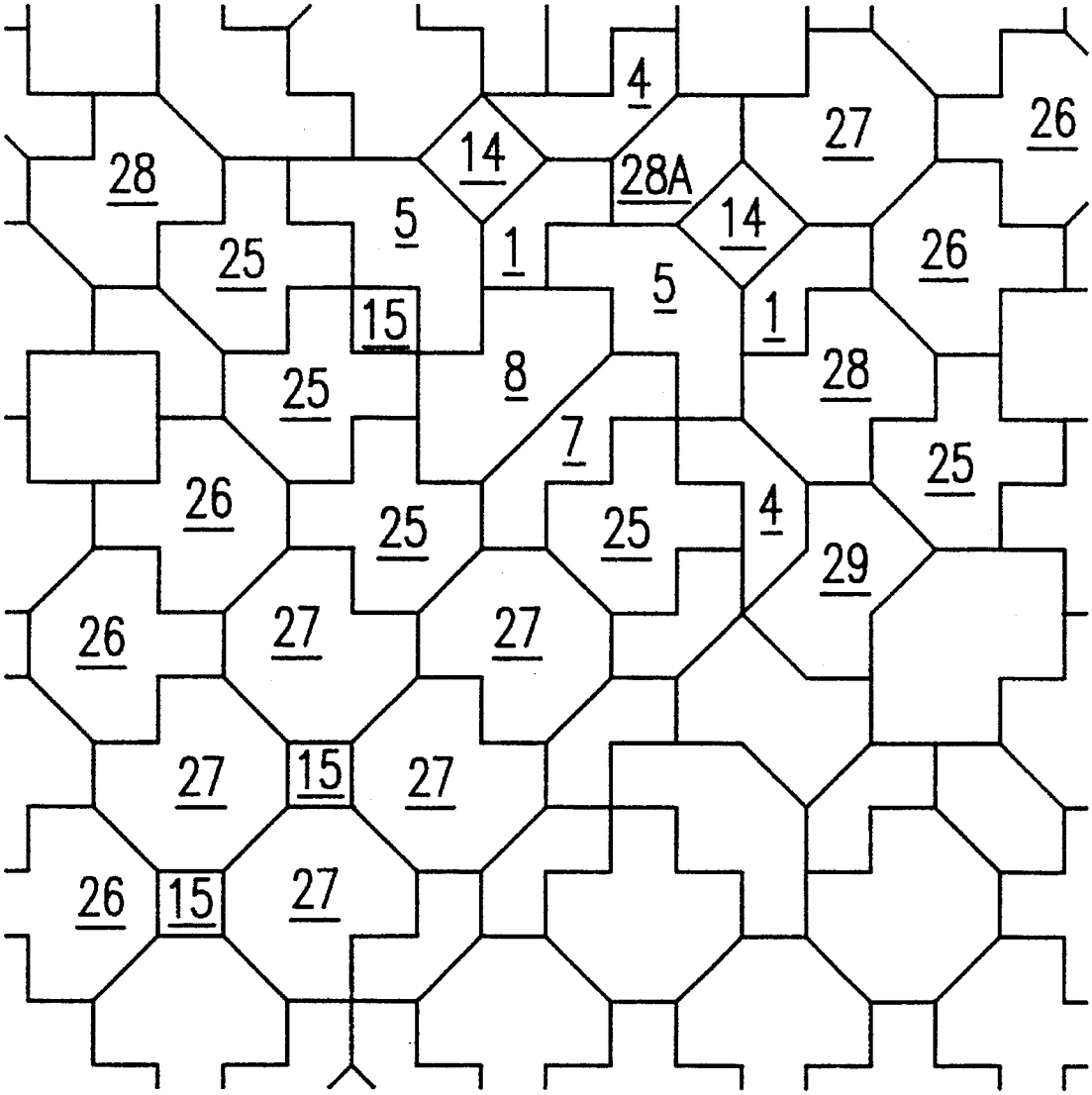
FIG. 24 shows an example of a layout using most of the elements.

FIG. 24 shows how it is theoretically possible to combine all the shown elements.

Figure 25:
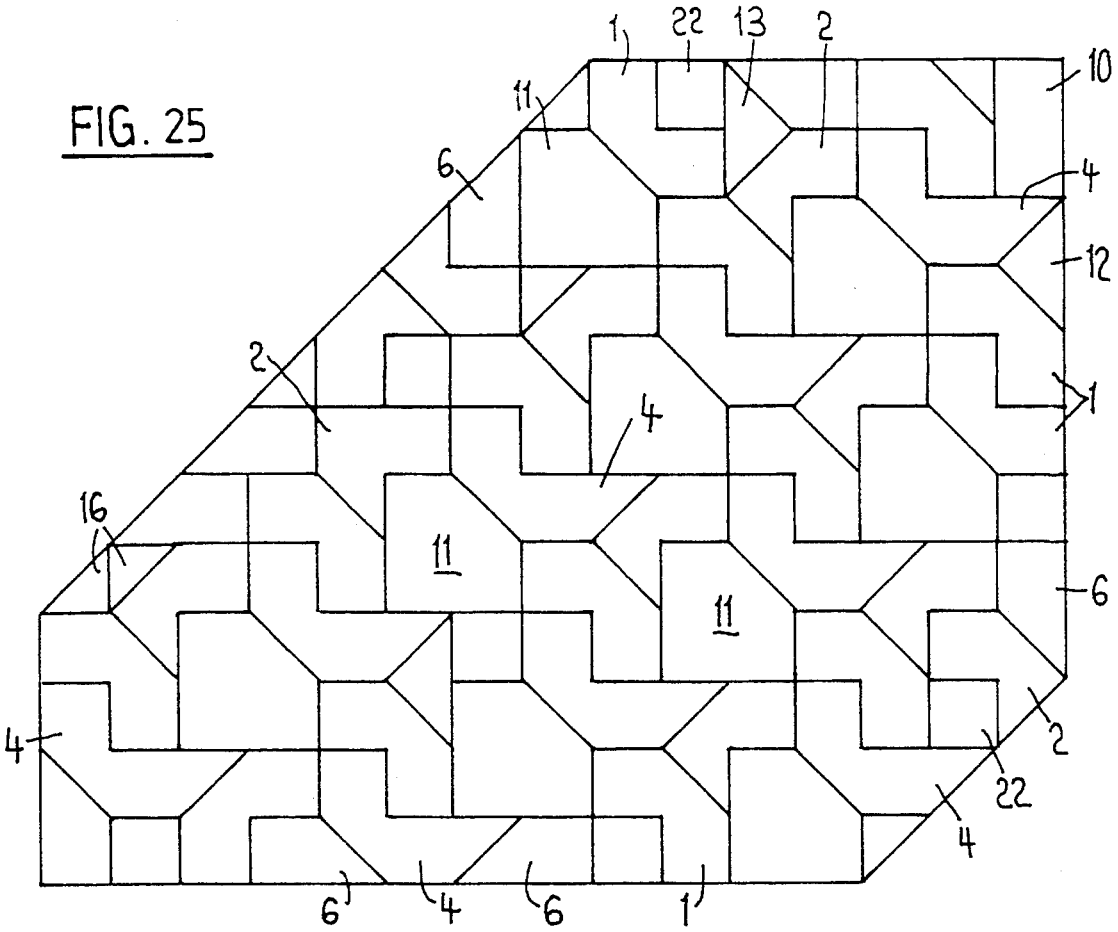
FIGS. 25–32 show further layout examples of the elements.
Figure 26:
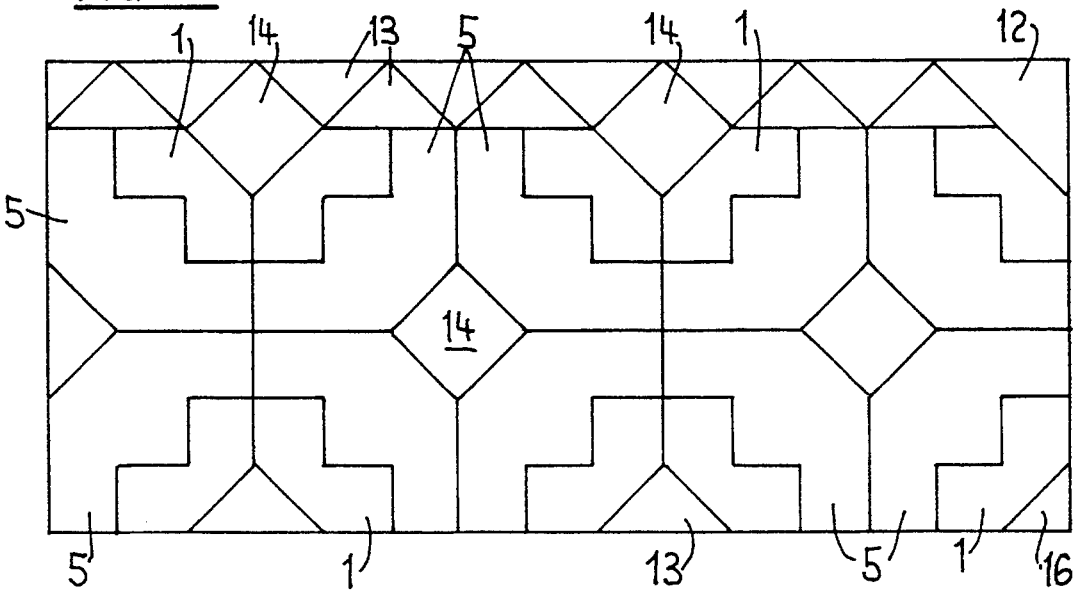
Figure 27:
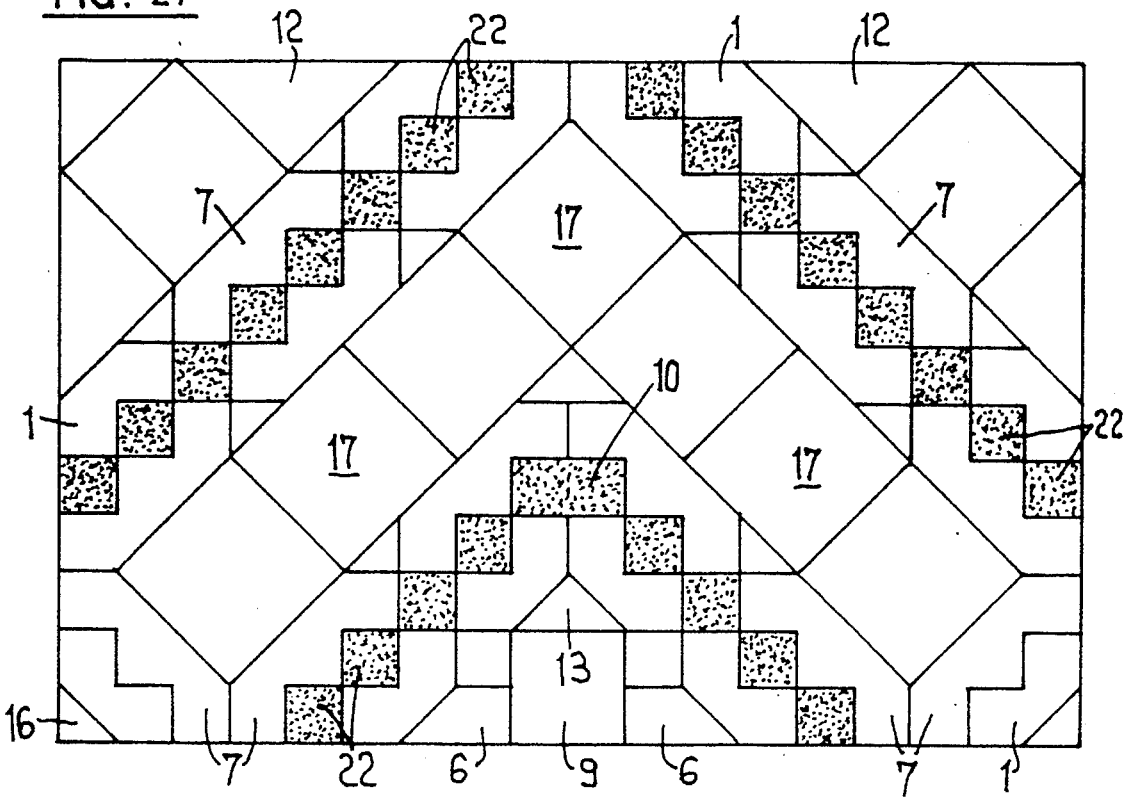
Figure 28:
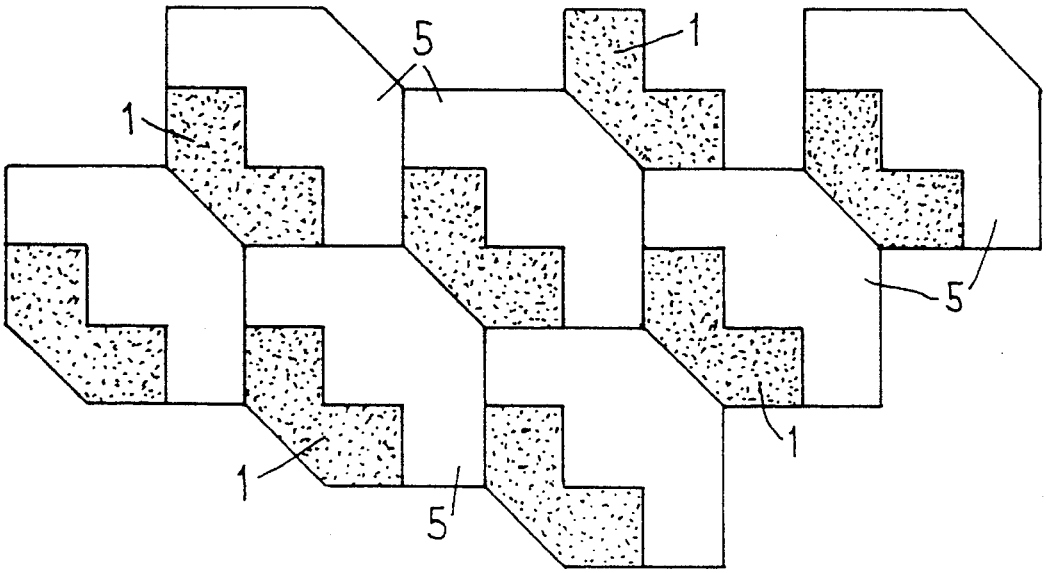

FIGS. 25 to 32 further illustrate that the first eight elements as well as the simple geometrical forms, all based on module a, already allow to assemble a great variety of forms and figures and that a straight-lined bordering, even with inclined sides as in FIG. 25, can be obtained in every case.

Figure 29:
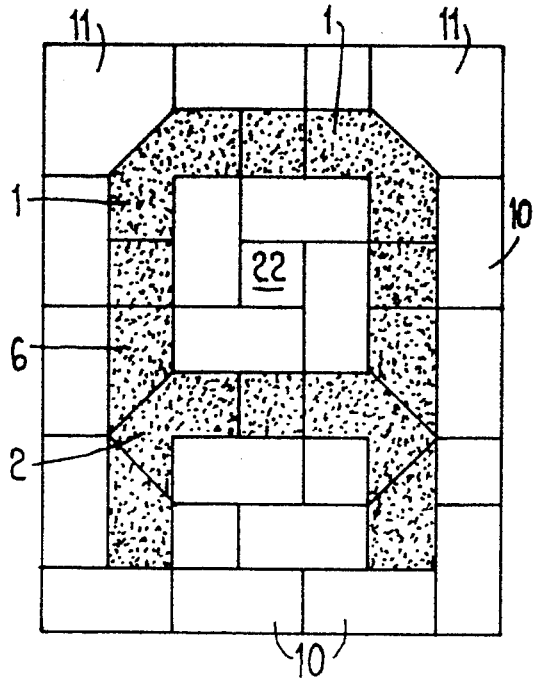
Figure 30:
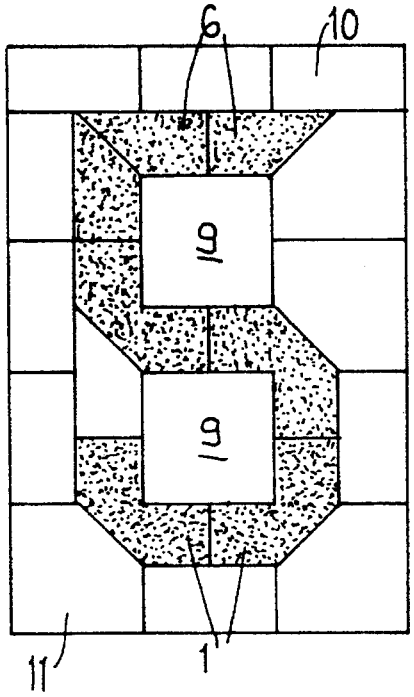
Figure 31:
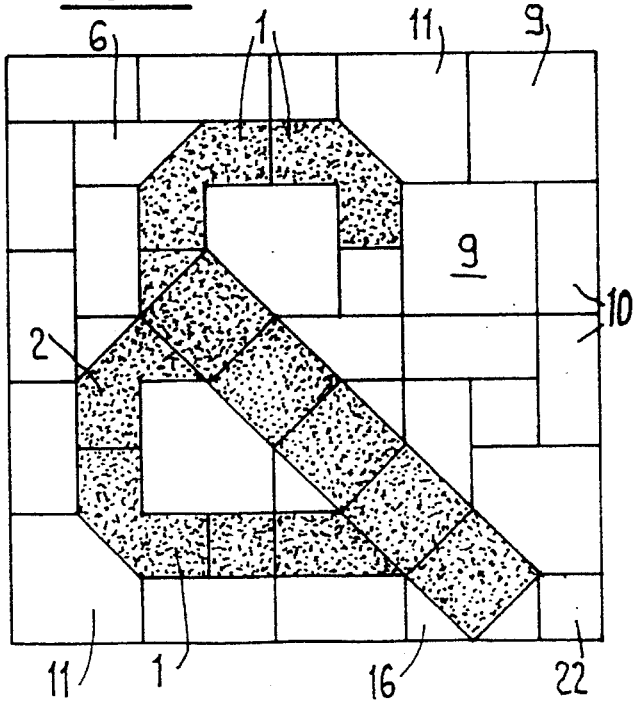
Figure 32:
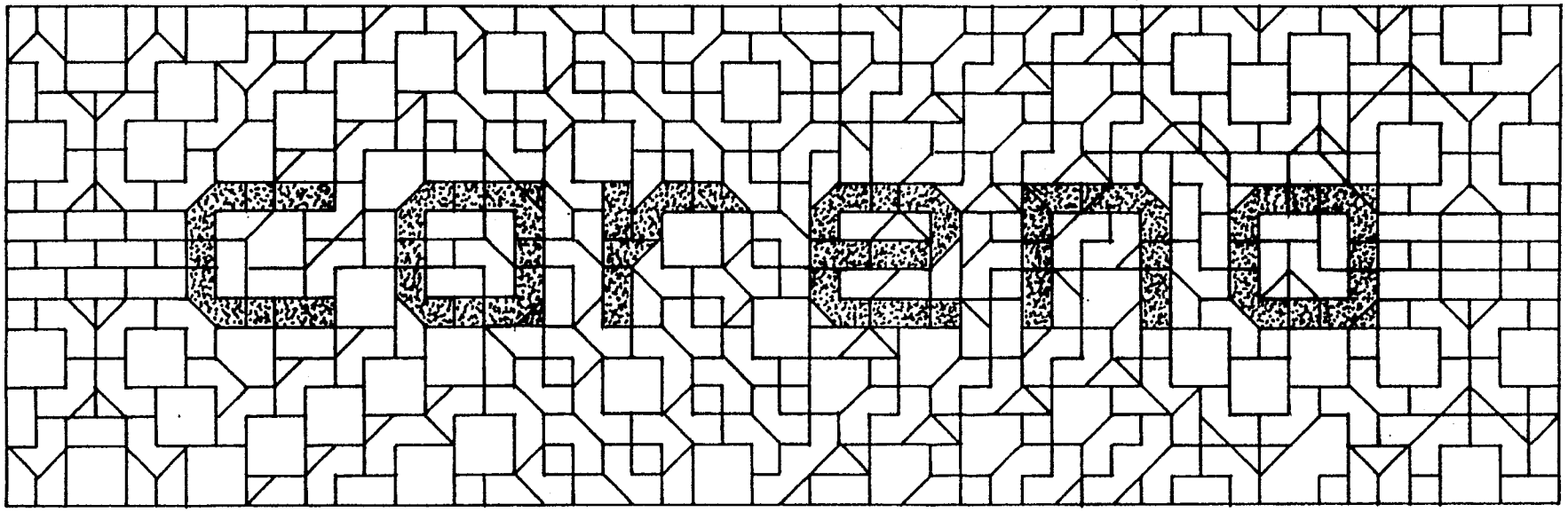

In FIGS. 29–31, a selection of a letter, a number and a symbol is illustrated in order to indicate that all capital and lower case letters, all numbers and all common symbols can be assembled and highlighted with the described elements, and that a straight-lined bordering can be obtained without the need of altering, i.e. cutting, reducing or otherwise adapting any of the elements. FIG. 32 illustrates how an entire line of writing can be inlaid with these elements and how a random pattern can be produced and assembled with a straight-lined bordering. It is understood that the elements can be differently colored for a better emphasis of figures.

The elements of FIGS. 1–32 are represented in a planar manner, i.e. without the third dimension, and it is evident to those skilled in the art that said elements may be in the form of slabs, paving stones, or thin ceramics tiles, which are suitable for paved or ceramics floors or as wall coverings. Of course, it is also possible to produce said elements or certain elements among them in such a thickness as to be suitable as elements for stairs or palisades.

Figure 35:
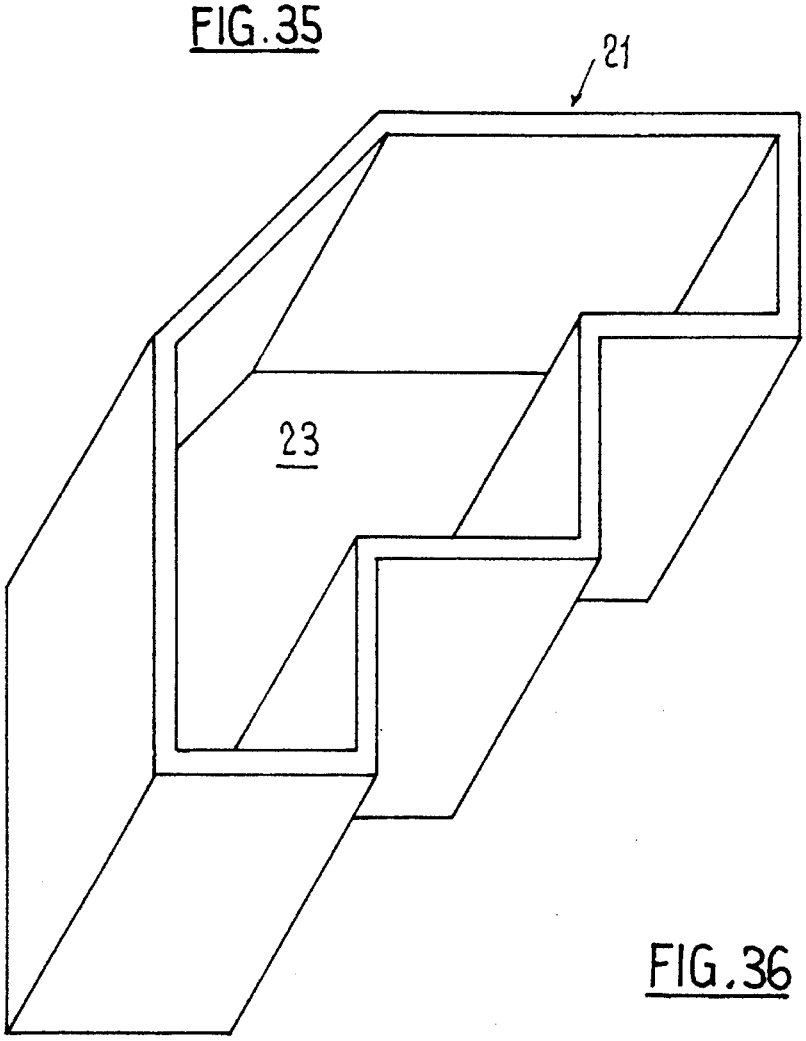
FIGS. 35 and 36 show elements 1 and 5 in the form of trough stones.
Figure 36:
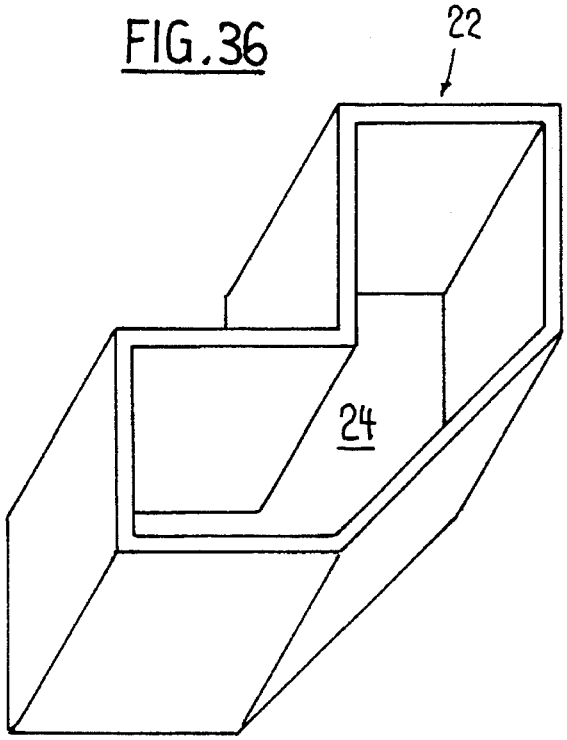

Furthermore, by way of examples, FIGS. 35 and 36 show that elements 5 and 1 can be designed as trough stones 21 and 22, respectively. It is understood that all other elements can be formed as trough stones as well. These trough stones can be arranged in groups and may also be completed by other elements as previously described. Bottoms 23 resp. 34 may be manufactured in one piece with the trough bodies or as separate parts.

Figure 33:
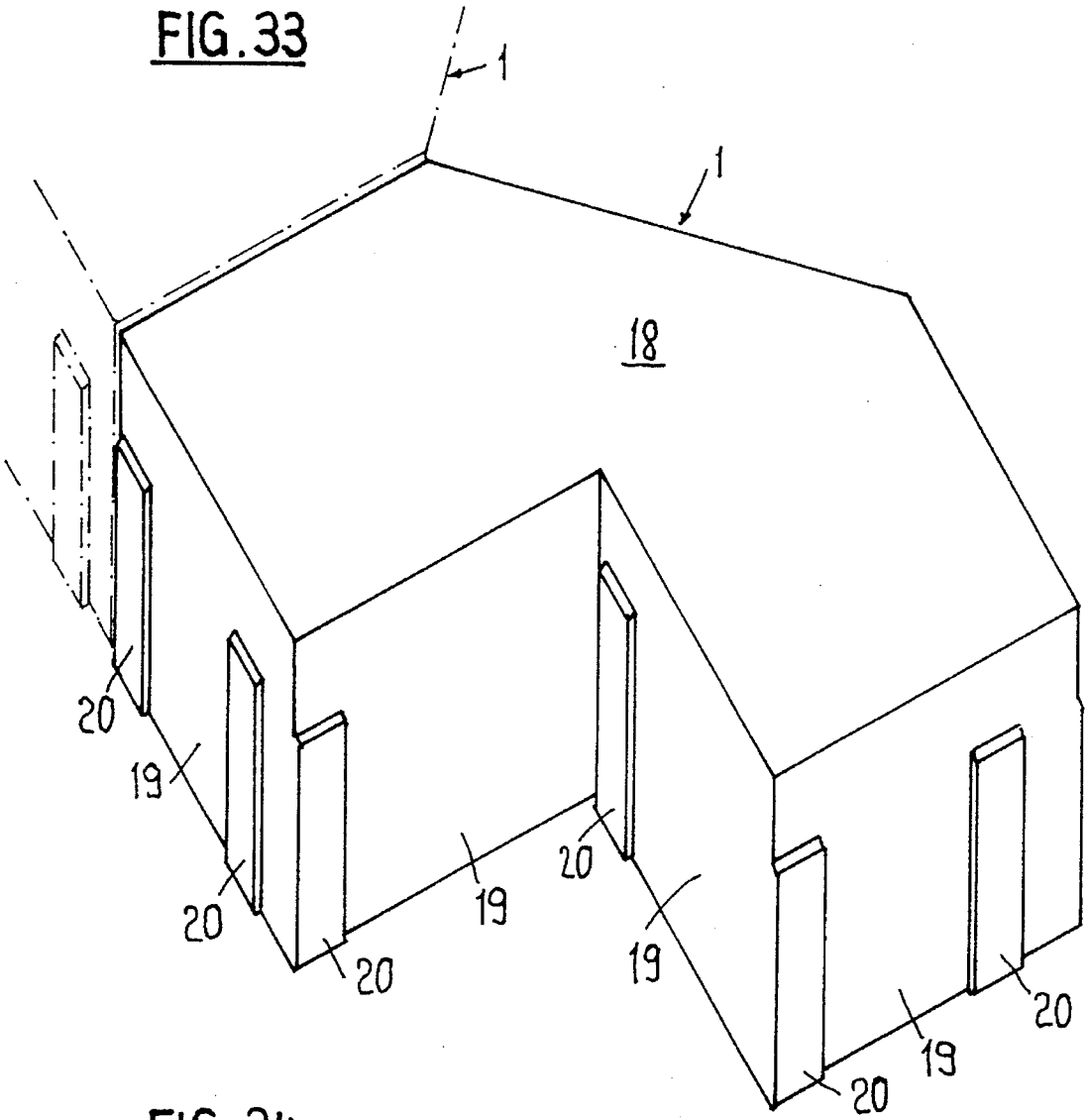
FIG. 33 shows element 1 in the form of a paving stone.
Figure 34:
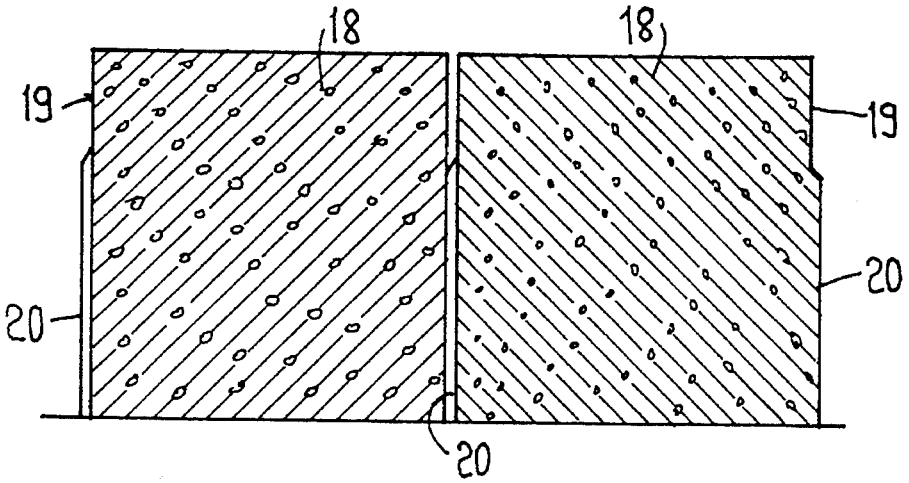
FIG. 34 shows a cross-section of the stone of FIG. 33.

FIGS. 33 and 34 show the use of first element 1, for example, as a paving stone 18 whose side surfaces 19 are provided with spacing joggles 20 which do not extend over their entire height. These spacing joggles are arranged on each side in such a manner that the adjoining stones will interlock and that a small joint width is obtained whereby the walking comfort is improved.

I claim:

1. A set of concrete or ceramic elements having surfaces for the creation of at least one of letters, numbers, symbols, and straight borders in floor or wall coverings, wherein each element of said set is designed in a modular manner on the basis of a unitary length a, and wherein said set of elements includes a first element having a surface consisting of two squares and a corner triangle located between said two squares, each of said squares having sides of said unitary length a, said squares adjoining along the entire length of at least one of their sides, and said triangle having a hypotenuse of length $b=a\sqrt{2}$.

2. The set of elements of claim 1, wherein said elements comprise paving stones having sides extending perpendicular to said surfaces of said set of elements and further comprising spacing joggles provided on said perpendicular sides of said paving stones under said surfaces such that adjoining paving stones will interlock.

3. The set of elements of claim 1, in wherein said elements comprise trough stones having sides extending perpendicular to said surfaces of said set of elements, wherein said surfaces of said elements define the bottoms of said trough stones, and wherein the bottoms of said elements are manufactured in one piece with the sides of the trough stones.

4. The set of elements of claim 1, wherein said set of elements further includes at least one of the following elements: a square element having sides of said unitary length a; a square element having sides of length 2*a*, equal to twice said unitary length a; a square element having sides of said length b, equal to $\underline{a}\sqrt{2}$; a rectangle element having a length 2*a* and a width a; a right triangle element having sides of length 2*a* and a hypotenuse of length 2*b*; a right triangle element having sides of length b and a hypotenuse of length 2*a*; and a right triangle element having sides of length a and a hypotenuse of length b.

5. The set of elements of claim 1, wherein said set of elements further includes a polygonal element consisting of two adjoining squares having sides of said unitary length a, wherein one of said squares is bisected along a diagonal to form a right triangle having a hypotenuse of length $b=a\sqrt{2}$.

6. The set of elements of claim 1, in wherein said elements comprise trough stones having sides extending perpendicular to said surfaces of said set of elements, wherein said surfaces of said elements define the bottoms of said trough stones, and wherein the bottoms of said elements are manufactured as separate parts.

* * * * *